US008706009B2

(12) United States Patent
Endoh

(10) Patent No.: US 8,706,009 B2
(45) Date of Patent: Apr. 22, 2014

(54) IMAGE FORMING APPARATUS

(75) Inventor: Keisuke Endoh, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 13/218,833

(22) Filed: Aug. 26, 2011

(65) Prior Publication Data

US 2012/0057892 A1 Mar. 8, 2012

(30) Foreign Application Priority Data

Sep. 7, 2010 (JP) ..... 2010-200107

(51) Int. Cl.
*G03G 15/08* (2006.01)
*G03G 15/16* (2006.01)
*G03G 15/01* (2006.01)

(52) U.S. Cl.
USPC ..... 399/257; 399/66; 399/301

(58) Field of Classification Search
USPC ..... 399/257, 66, 301
See application file for complete search history.

(56) References Cited

U.S. PATENT DOCUMENTS 5,732,310 A 3/1998 Hiroshima et al.
7,340,189 B2 * 3/2008 Itagaki et al. ..... 399/257 X
7,373,097 B2 * 5/2008 Ehara ..... 399/301 X
7,493,072 B2 2/2009 Sato et al.
2009/0003865 A1 * 1/2009 Endou et al. ..... 399/66
2009/0214233 A1 * 8/2009 Murauchi et al. ..... 399/30
2010/0086320 A1 4/2010 Koizumi et al.

FOREIGN PATENT DOCUMENTS

CN 1139221 A 1/1997
JP 09-034243 A 2/1997
JP 2006-106069 A 4/2006
JP 2007-179008 A 7/2007

OTHER PUBLICATIONS

Office Action in Chinese Application No. 201110257611.0 dated Dec. 4, 2013.

* cited by examiner

*Primary Examiner* — Sandra Brase
(74) *Attorney, Agent, or Firm* — Fitzpatrick, Cella, Harper & Scinto

(57) ABSTRACT

The image forming apparatus includes a discharge execution section for forcedly discharging toner from a developing device and forming a toner image on a photosensitive drum, in which a primary transfer roller transfers the toner image formed on the photosensitive drum by the discharge execution section by applying, to a predetermined area part of the toner image, a first transfer bias having a predetermined transfer efficiency with respect to an intermediate transfer belt and applying, to a part excluding the predetermined area part of the toner image, a second transfer bias whose transfer efficiency is at least smaller than the predetermined transfer efficiency of the first transfer bias.

10 Claims, 12 Drawing Sheets

IMAGE FORMING APPARATUS

BACKGROUND OF THE INVENTION

1. Field of the Invention

The present invention relates to an image forming apparatus that uses an electrophotographic recording process, such as a laser printer, a copier, or a facsimile machine.

2. Description of the Related Art

Conventionally, toner discharge is known as a technology for electrophotographic image forming apparatuses. The toner discharge is, for example, an operation for forcedly discharging toner from a developing device on a regular basis and supplying the discharged toner to a cleaning blade for a photosensitive drum. The toner discharge needs to be executed from a developing roller for the following reason. That is, in a case of printing a large number of images having a low printing ratio, toner supplied from a toner container to a developing roller position remains within the developing device without being transferred, and degraded toner accumulates on a developing roller part. If the image forming (printing) is not performed for a certain period while the accumulated toner is left on the developing roller part, an adhesive force of toner may rise to cause toner fusion with respect to the developing roller and generate a defect image with lines caused by fixed toner in a toner-fused part. Therefore, an image forming apparatus needs a processing for forcedly discharging and removing toner on a regular basis in order to remove the toner remaining on the developing roller. In other words, it is necessary to discharge toner corresponding to one round of the developing roller.

Further, in a case where printing continues at a low printing ratio, a case where printing continues with small-size paper, a case where printing continues at high temperature and humidity, and other such cases, a cleaning blade for the photosensitive drum raises the following problems. That is, the cleaning blade may curl up, an edge portion of the cleaning blade may chip, or the cleaning blade may chatter (cause stick-slip). If curling up, the cleaning blade becomes unable to clean, and if the edge portion chips or chatters, toner runs through. As a measure against this phenomenon, Japanese Patent Application Laid-Open No. H09-034243 discloses a technology in which toner for discharge is distributed and supplied to each of cleaning blades and used as a lubricant to thereby prevent the cleaning blade from curling up and the edge portion from chipping or chattering.

As described above, the toner discharge has an object to clean out the degraded toner and perform maintenance of the cleaning blade. However, from the viewpoint of effective use of a toner resource, the toner consumed in the toner discharge does not play an original role of being formed as an image. Therefore, there is a demand that the toner consumed in the toner discharge be effectively used as an image.

SUMMARY OF THE INVENTION

A purpose of the present invention is to solve at least one of the above-mentioned problems and other such problems. The object of the present invention is to allow effective use of toner consumed in toner discharge as, for example, a toner image involved in color deviation detection.

A purpose of the present invention is to provide an image forming apparatus comprising image forming sections provided for respective colors, wherein each of the image forming sections includes an electrophotosensitive member, a developing unit that develops a toner image on the electrophotosensitive member, a transfer unit that applies a transfer bias and transfers the toner image formed on the electrophotosensitive member onto a belt for transferring the toner image formed on the electrophotosensitive member, and an electrophotosensitive member cleaning unit that removes toner remaining on the electrophotosensitive member, said image forming apparatus including a detection unit that detects the toner image transferred onto the belt by the image forming section, and a toner discharge unit that forcedly discharges toner from the developing unit and forms the toner image on said electrophotosensitive member, the transfer unit applies a first transfer bias with a predetermined transfer efficiency with respect to the belt, for a predetermined area part of the toner image, and applies a second transfer bias whose transfer efficiency is at least smaller than the predetermined transfer efficiency of the first transfer bias, for a part excluding the predetermined area part of the toner image.

The present invention allows effective use of the toner consumed in the toner discharge as, for example, the toner image involved in the color deviation detection.

Further features of the present invention will become apparent from the following description of exemplary embodiments with reference to the attached drawings.

DESCRIPTION OF THE EMBODIMENTS

Hereinafter, embodiments of the present invention are described in detail with reference to the accompanying drawings. However, constitutional elements described in the embodiments are mere examples, and unless otherwise specified, the scope of this invention is not to be limited only thereto.

(First Embodiment)

(Overall Construction)

Figure 1A:
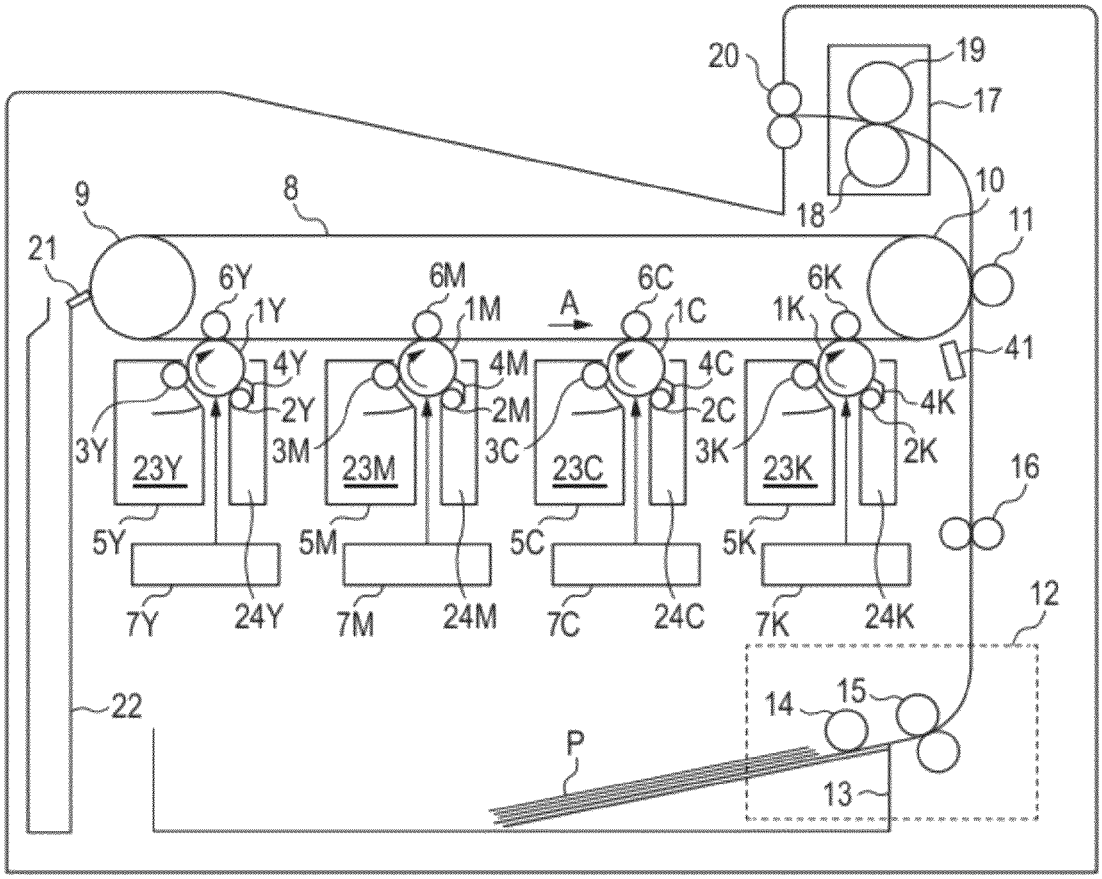
FIG. 1A is a schematic diagram of an image forming apparatus according to first to third embodiments.

A first embodiment is described by taking a color electrophotographic image forming apparatus as an example. FIG. 1A is referenced to describe an outline of an overall construction of the color electrophotographic image forming apparatus. An image forming apparatus described in this embodiment is a laser printer using an electrophotographic image forming process. A color image forming apparatus (hereinafter, referred to as "apparatus main body") illustrated in FIG. 1A includes process stations (process cartridges) (image forming sections) 5Y, 5M, 5C, and 5K that are detachably attachable to the apparatus main body. The four process stations 5Y, 5M, 5C, and 5K have the same structure, but are different from one another in that images are formed by using toner (developer) in different colors, that is, yellow (Y), magenta (M), cyan (C), and black (K). Note that the symbols YMCK are omitted hereinbelow except when a specific process station is described. The process stations 5 each include a toner container 23, a photosensitive drum 1 being an electrophotosensitive member, a charging roller 2, a developing roller 3, a cleaning blade 4 (electrophotosensitive member cleaning unit), and a waste toner container 24. An exposure device 7 is located below the process station 5, and performs exposure on the photosensitive drum 1 based on an image signal.

In this embodiment, an organic photo-conductive (OPC) photosensitive drum having a diameter of 25 mm and having a negatively charging characteristic is used as each of the photosensitive drums 1, and the respective photosensitive drums 1 are each driven to rotate at a peripheral velocity (process speed) of 180 mm/sec during image forming thereof. The photosensitive drum 1 is uniformly charged to a predetermined polarity/potential by the charging roller 2 in the course of rotation. Then, electrostatic latent images corresponding to the first to fourth color component images (yellow, magenta, cyan, and black component images) of respectively desired color images are formed on the photosensitive drums 1 subjected to image exposure by the exposure device 7. The charging roller 2 is driven to rotate in conformity to rotation of the photosensitive drum 1. The exposure device 7 used in this embodiment is a polygon scanner using a laser diode, images a laser beam modulated according to image information on the photosensitive drum 1, and forms the electrostatic latent image. Writing laser exposure light is performed from a positional signal (BD signal) within the polygon scanner for each scan line in a main scanning direction (direction perpendicular to a transport direction of a transfer material) while being delayed by a predetermined time. Further, during the image forming on the transfer material, the writing is performed at predetermined intervals between the process stations in a sub-scanning direction (transport direction of the transfer material). According to this configuration, the exposure is always performed in the same position on the photosensitive drums 1 of the first to fourth process stations Y, M, C, and K to thereby suppress a color deviation. The electrostatic latent images formed on the photosensitive drums 1 are developed by the developing rollers 3 of the first to fourth process stations Y, M, C, and K. The developing roller 3 causes toner of each of the colors to adhere to the electrostatic latent image on the photosensitive drum 1 so as to be developed as a toner image. The toner within each developing device is non-magnetic one-component toner and is negatively charged, and the development of the electrostatic latent image is performed by a non-magnetic one-component contact developing method. The developing rollers 3 each rotate at a process speed of 100% in a forward direction with respect to the photosensitive drum 1 and have a diameter of 12 mm. A developing bias is applied to the developing roller 3 by a developing bias power source (not shown), thereby performing the development.

An intermediate transfer belt unit includes an intermediate transfer belt 8, a drive roller 9, and a secondary transfer opposing roller 10. Further, a primary transfer roller 6 is disposed inside the intermediate transfer belt 8 so as to oppose each of the photosensitive drums 1, and is configured to have a primary transfer bias of a positive polarity applied thereto by a primary transfer bias power source (not shown). Note that in a sense of forming toner images that have been primarily transferred on a belt, the primary transfer rollers 6 and the above-mentioned process stations are referred to collectively as the image forming section. The drive roller 9 is caused to rotate by a motor (not shown) to thereby cause the intermediate transfer belt 8 to loop and the secondary transfer opposing roller 10 to rotate accordingly. In this embodiment, the drive roller 9 has a diameter of 30 mm. The intermediate transfer belt 8 exhibits a rotation speed of 180 mm/sec. The photosensitive drums 1 are each caused to rotate in a direction indicated by the arrow, the intermediate transfer belt 8 is caused to rotate in a direction indicated by the arrow A, and the primary transfer bias of a positive polarity is applied to the primary transfer roller 6. Accordingly, the toner images on the photosensitive drum 1 are primarily transferred onto the intermediate transfer belt 8 (onto a belt) in order from the toner image on the photosensitive drum 1Y. After that, the overlaid toner images of the four colors are transported to a secondary transfer roller 11. The cleaning blade 4 for the photosensitive drum 1 is in press contact with the photosensitive drum 1, and removes residual toner remaining on a front surface of the photosensitive drum 1 without being transferred onto the intermediate transfer belt 8 and other residues on the photosensitive drum (onto the electrophotosensitive member).

A feed/transport device 12 includes a sheet feed roller 14 for feeding a transfer material P from within a sheet feed cassette 13 for receiving the transfer material P and a transport roller pair 15 for transporting the fed transfer material P. Then, the transfer material P transported from the feed/transport device 12 is transported to the secondary transfer roller 11 by a registration roller pair 16. In the transfer from the intermediate transfer belt 8 onto the transfer material P, a bias of a positive polarity is applied to the secondary transfer roller 11 to thereby transfer the toner images of the four colors on the intermediate transfer belt 8 onto the transported transfer material P (hereinafter, referred to as "secondary transfer"). The transfer material P onto which the toner images have been transferred are transported to a fixing device 17, and have the toner images fixed to the front surface by being heated and pressurized by a fixing film 18 and a pressure roller 19. The fixed transfer material P is delivered by a delivery roller pair 20.

In the image forming apparatus including the above-mentioned intermediate transfer belt 8, toner remaining on and adhering to a front surface of the intermediate transfer belt 8 becomes a cause for a smudge on the back of the transfer material P or a stained image. Specific examples of the residual toner include toner remaining on the intermediate transfer belt 8 after the secondary transfer onto the transfer material P and fogging toner adhering to jammed paper or a non-image portion. In addition, examples of the residual toner include toner image for color deviation detection (also referred to as "test pattern image") that has been transferred from the photosensitive drum 1 so as to be used for color deviation detection for color deviation control. Those kinds of toner remaining on and adhering to the intermediate transfer belt 8 are removed by a transfer belt cleaning blade 21, and accumulated in a container 22 for collection. Note that the image forming apparatus according to this embodiment includes a color deviation detection sensor 41 between the registration roller pair 16 and the secondary transfer roller 11.

(Control Block Diagram)

Figure 1B:
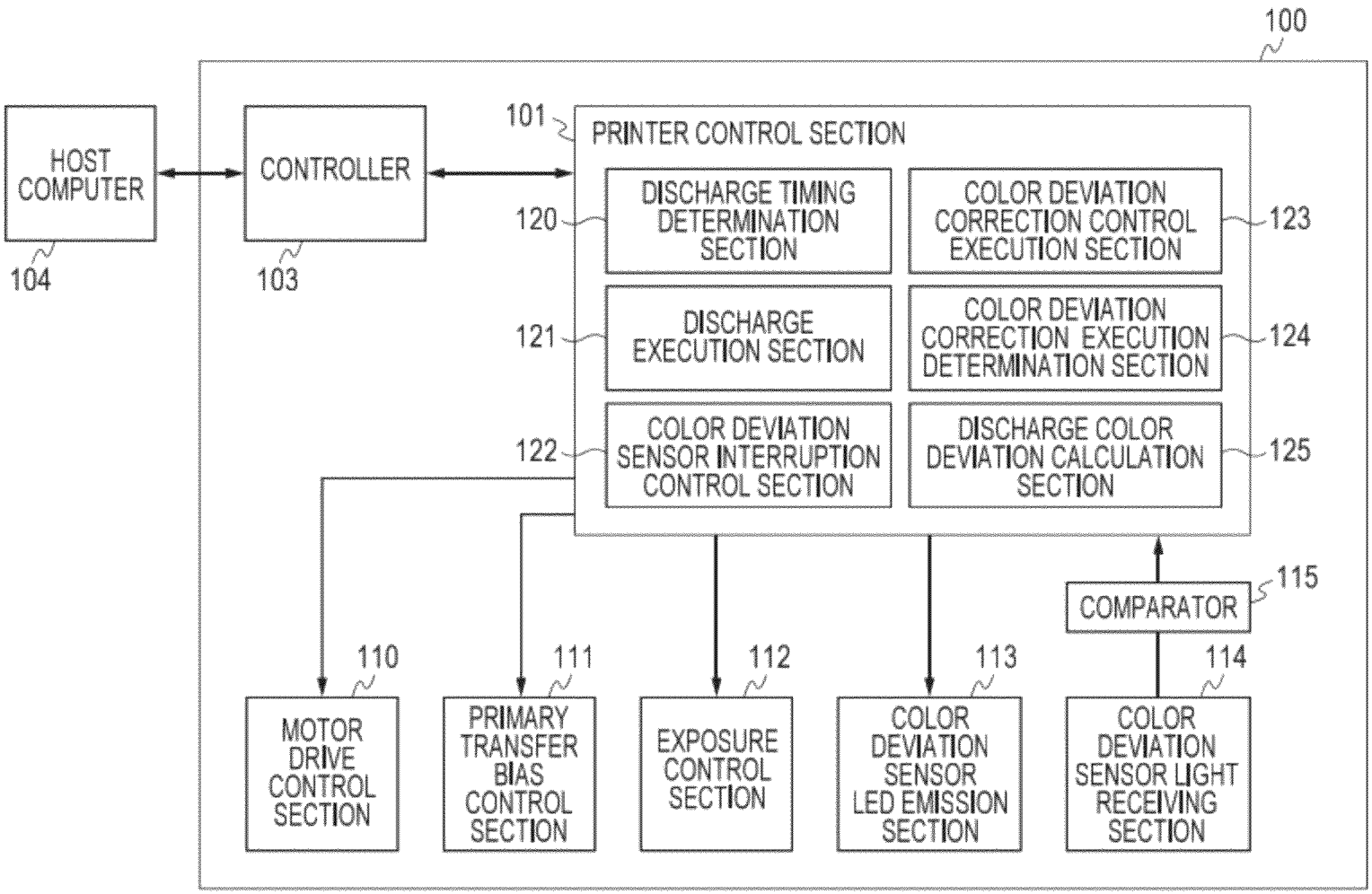
FIG. 1B is a block diagram of a system configuration of the image forming apparatus.

FIG. 1B is a control block diagram according to this embodiment. A printer control section 101 includes a CPU (not shown) and a memory (not shown), and executes programs for controlling respective devices within a printer 100 functioning as the image forming apparatus. The printer control section 101 controls respective components of the image forming apparatus by using the memory as a work area based on various control programs. A host computer 104 transfers data to be printed to the printer 100. A controller 103 allows communications to be performed between the printer 100 and the host computer 104. The controller 103 receives the image information and a printing command from the host computer 104, analyzes the received image information, and converts the image information into bitmap data. During the printing, the controller 103 transmits the bitmap data to the printer control section 101 in synchronization with a TOP signal. A motor drive control section 110 causes motors (not shown) for driving the photosensitive drum 1 and the drive roller to rotate according to an instruction issued by the printer control section 101. A primary transfer bias control section 111 controls a power source of the primary transfer bias applied between the primary transfer roller 6 and the photosensitive drum 1 according to an instruction issued by the printer control section 101. An exposure control section 112 controls the exposure device 7 according to an instruction issued by the printer control section 101. A color deviation sensor LED emission section 113 controls a light emitting element 51 of the color deviation detection sensor 41 according to an instruction issued by the printer control section 101. A color deviation sensor light receiving section 114 converts a signal received from a light receiving element 52 of the color deviation detection sensor 41 into an electrical signal. As illustrated in FIG. 2C described later, a comparator 115 binarizes an output value ((c-1) of FIG. 2C) of the color deviation detection sensor 41 output from the color deviation sensor light receiving section 114 into a signal ((c-2) of FIG. 2C), and the binarized signal is input to the printer control section 101. Further, hereinbelow, it is assumed that the printer control section 101 manages a control sequence described later by using, for example, a counter. Note that, for example, a timer may be used in place of the counter in the above-mentioned configuration.

Note that respective functions of the printer control section 101 may be implemented by the CPU executing various control programs, or a dedicated circuit for a specific purpose (ASIC) may be caused to perform part or all of the functions.

(Color Deviation Detection Sensor and Color Deviation Correction)

Figure 2A:
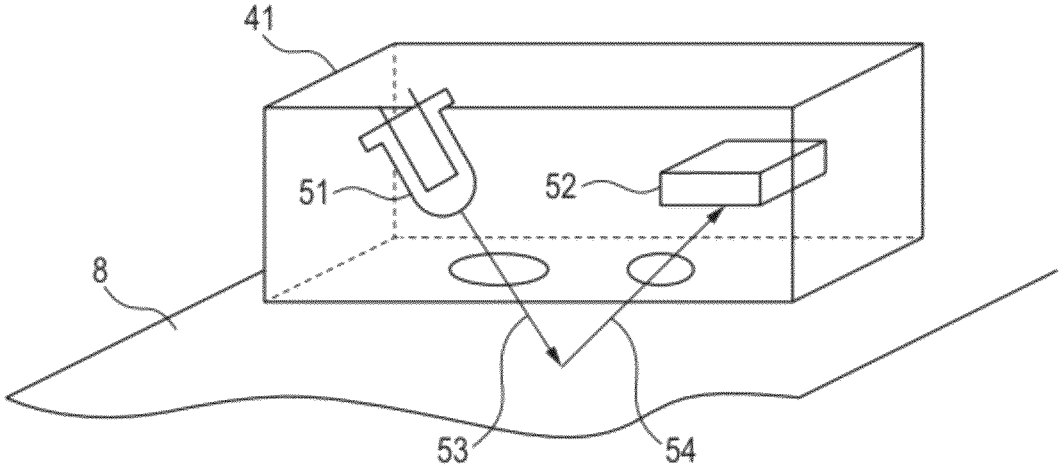
FIG. 2A is a schematic diagram of a color deviation detection sensor according to the first to third embodiments.

FIG. 2A is an explanatory diagram of a construction of the color deviation detection sensor 41. The color deviation detection sensor 41 includes the light emitting element 51 such as an LED, the light receiving element 52 such as a photodiode, an IC (not shown) for processing light-received data, and a holder (not shown) for receiving those components. The light emitting element 51 irradiates the intermediate transfer belt 8 with light (53). The light receiving element 52 receives reflected light (54) from the intermediate transfer belt 8 or from a toner patch on the intermediate transfer belt 8 to thereby detecting an intensity of the reflected light. The color deviation detection sensor 41 according to this embodiment is constructed to detect specularly reflected light. In the color deviation detection sensor 41, when the front surface of the intermediate transfer belt 8 is being exposed (when a toner amount thereon is zero), the light receiving element 52 detects the reflected light. This is because the front surface of the intermediate transfer belt 8 has glossiness. On the other hand, if a toner image is formed on the intermediate transfer belt 8, as a density (toner amount) of the toner patch increases, the reflected light detected by the light receiving element 52 decreases, and a specular reflection output of the light receiving element 52 gradually decreases. This is because the toner covering the front surface of the intermediate transfer belt 8 causes the specularly reflected light from the front surface of the intermediate transfer belt to decrease. (c-1) of FIG. 2C illustrates how the light receiving element 52 detects the reflected light in order of the intermediate transfer belt 8 → a part of the intermediate transfer belt 8 on which the toner image is formed (hereinafter, referred to as "toner belt") → the intermediate transfer belt 8. A signal output from the light receiving element 52 is input to the comparator 115, is converted into 1 (ON) if a signal level is higher than a predetermined threshold level and 0 (OFF) if the signal level is lower than the predetermined threshold level, and is input to the printer control section 101 ((c-2) of FIG. 2C). Further, the printer control section 101 starts a program for a color deviation sensor interruption control section 122 to thereby be able to accurately measure a timing at which a change occurs in a logic of the signal output from the color deviation sensor light receiving section 114 which is binarized by the comparator 115.

Figure 2B:
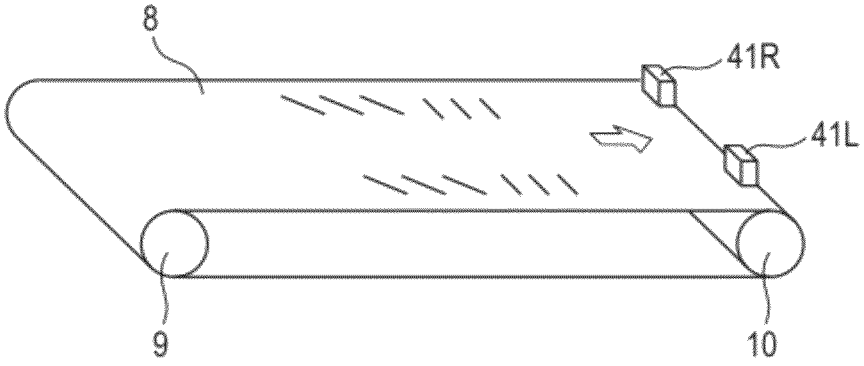
FIG. 2B is a diagram of an arrangement thereof.
Figure 2C:
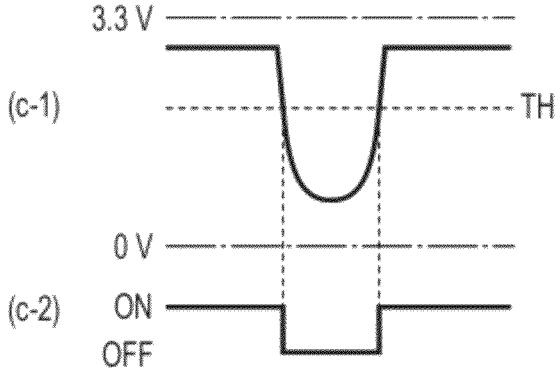
FIG. 2C is a graph illustrating an output obtained when a toner pattern is read by the color deviation detection sensors.

As illustrated in FIG. 2B, the color deviation detection sensor 41 thus constructed is located in each of positions (41R and 41L) on both sides (both edge portions in a direction perpendicular to the loop direction) of a downstream portion in a loop direction of the intermediate transfer belt 8 (as indicated by the hollow arrow in FIG. 2B), that is, a plurality of color deviation detection sensors 41 are located. Note that FIG. 2B is a diagram of the intermediate transfer belt 8 of FIG. 1A viewed from a process station side.

In the image forming apparatus including the color deviation detection sensor 41, by a known technology, a patch pattern (test pattern image) for the color deviation detection is formed on the intermediate transfer belt 8 during the standby of the image forming apparatus. Then, the formed patch pattern is detected by the color deviation detection sensor 41, the color deviation from a reference color in the sub-scanning direction (loop direction of the intermediate transfer belt 8) of the respective process stations is detected, and the color deviation therefrom in the main scanning direction (direction perpendicular to the sub-scanning direction) is detected. Then, the printer control section 101 performs color deviation correction control for notifying the controller 103 of color deviation information input from the color deviation sensor light receiving section 114. The controller 103 subjects the bitmap data to an electrical correction based on the color deviation information that has been notified, and performs control for suppressing the color deviation on the transfer material P. The information of which the printer control section 101 notifies the controller 103 includes, as information regarding the sub-scanning direction, information indicating by how many scan lines a laser beam light emitting timing (TOP signal output timing) of the other colors are delayed with reference to the laser beam light emitting timing of the reference color (Y). The notified controller 103 delays the timing to transmit the bitmap data to the printer control section 101 according to the information that has been notified of. Further, the information regarding the main scanning direction includes information indicating how much the laser beam light emitting timing of the other colors is progressed or delayed with reference to the laser beam light emitting timing of the reference color (K) in the main scanning direction. The notified controller 103 adjusts the timing to transmit the bitmap data to the printer control section 101 according to the information that has been notified.

(Discharge Control)

In the printer 100 according to this embodiment, the printer control section 101 causes a discharge timing determination section 120 to count a rotation number of the photosensitive drum 1 by using, for example, the counter (not shown). If a count value obtained by the discharge timing determination section 120 exceeds a fixed rotation number, control is performed so as to enter discharge control for forcedly discharging toner. The discharge timing determination section 120 counts the rotation number of the photosensitive drum 1 while the printer control section 101 is instructing the motor drive control section 110 to drive the motor (not shown) functioning to drive the photosensitive drum 1. During full-color printing, the photosensitive drums 1Y, 1M, and 1C for Y, M, and C have substantially the same rotation number, and during monochrome printing, only the photosensitive drum 1K for K is rotating. In consideration thereof, the discharge timing determination section 120 counts the rotation numbers at two stations, in other words, a Y station including the photosensitive drum 1Y and a K station including the photosensitive drum 1K.

If the discharge timing determination section 120 determines that the Y-station rotation number exceeds a predetermined threshold value during a printing operation, the printer control section 101 interrupts the printing operation at that timing. Then, the printer control section 101 causes a discharge execution section 121 to execute a full-color discharge operation targeted for all the colors. The discharge timing determination section 120 clears the counter values of both the Y-station rotation number and the K-station rotation number when the full-color discharge operation is completed. Further, if the discharge timing determination section 120 determines that the K-station rotation number exceeds a predetermined threshold value during the printing operation, the printer control section 101 interrupts the printing operation at that timing. Then, the printer control section 101 causes the discharge execution section 121 to execute a monochrome discharge operation targeted for the K station. The discharge timing determination section 120 clears the counter value of the K-station rotation number when the monochrome discharge operation is completed.

(Details of Discharge Control)

Figure 3:
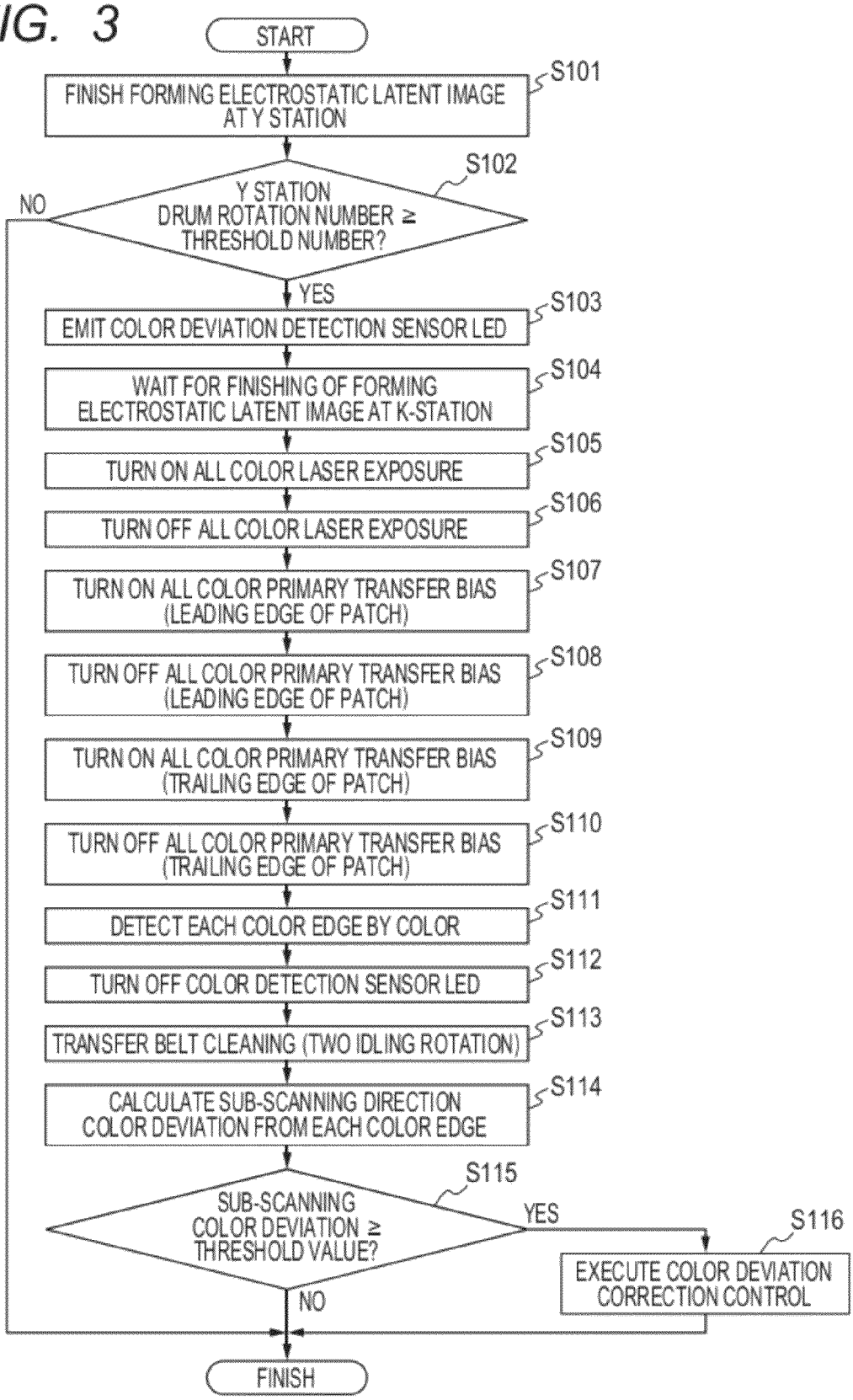
FIG. 3 is a flowchart of discharge control according to the first embodiment.
Figure 4:
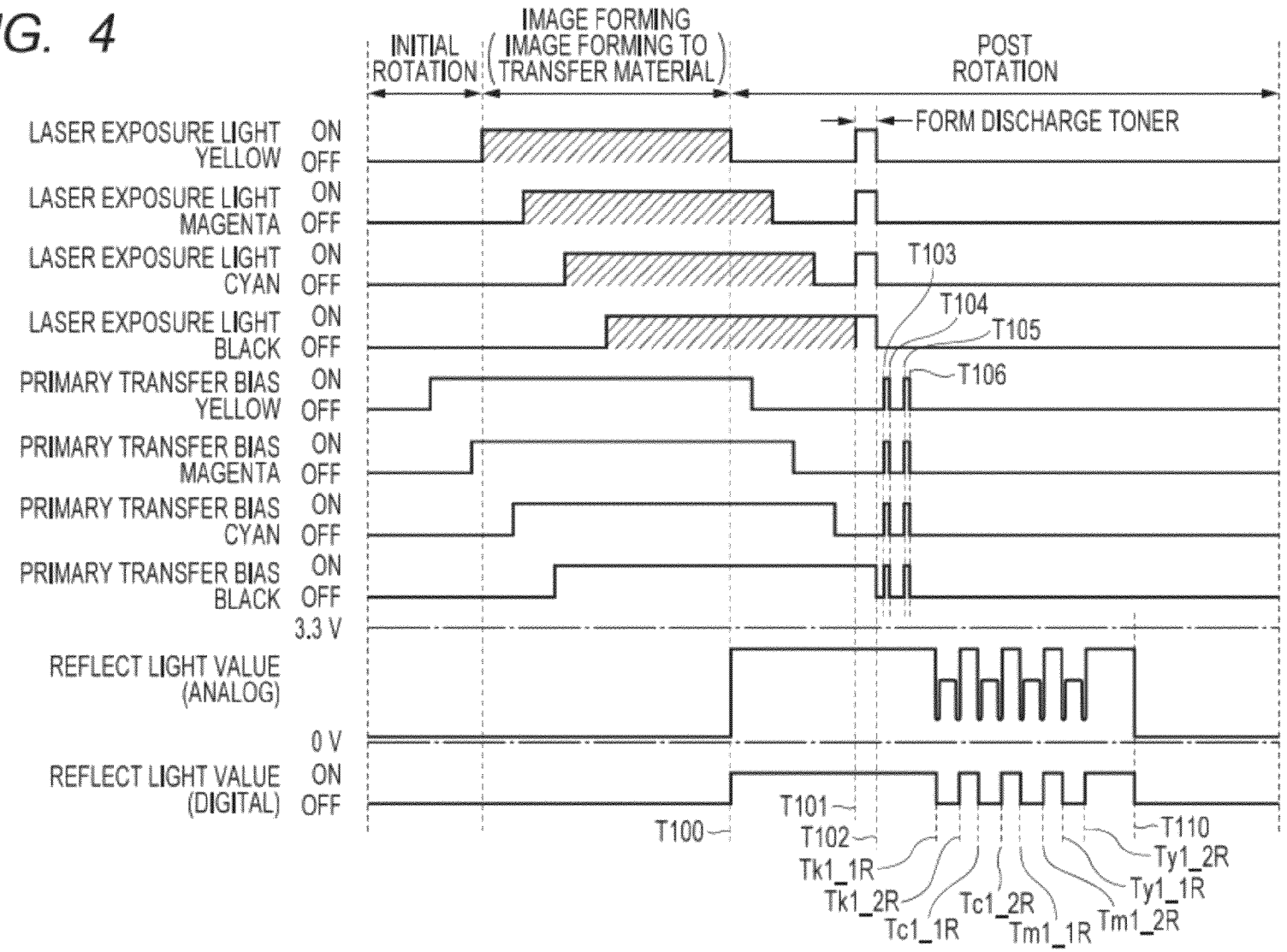
FIG. 4 is a timing chart of the discharge control according to the first embodiment.

In this embodiment, in the full-color discharge operation, by making use of the fact that the toner images of all the colors are created, the sub-scanning direction color deviation between the respective stations is detected, and an execution timing of the color deviation correction control is determined. This allows the toner consumed in the toner discharge to be effectively used as, for example, the toner image involved in the color deviation detection, which also leads to reduction of an execution frequency of the color deviation correction control. FIG. 3 to FIG. 6 are referenced to describe the discharge control according to this embodiment. FIG. 3 is a flowchart of the discharge control according to this embodiment. FIG. 4 is a timing chart of the discharge control according to this embodiment. Note that, although not shown in FIG. 4, a charging bias is applied over an interval including the image forming (image forming to the transfer material) and post-rotation (discharge toner formation) (that is, ON state). Further, although not shown in FIG. 4, in the same manner as the charging bias, the developing bias is applied over the interval including the image forming and the discharge toner formation (that is, ON state). Further, the laser exposure light (diagonally shaded areas) during the image forming performs exposure according to the bitmap data obtained from the controller 103, and the laser exposure light during the post-rotation performs an exposure operation according to an instruction issued by the printer control section 101. In FIG. 4, the horizontal axis represents time, and all timings within FIG. 4 are assumed to be set with reference to a printing start time point. Further, as the reflected light of the color deviation detection sensor 41, only an output value of one of two color deviation detection sensors 41R and 41L is illustrated (reflected light value), and an output value of the other exhibits substantially the same change.

The description is performed with reference to the flowchart of FIG. 3. In Step S101 (hereinafter, referred to as "S101"), the printer control section 101 causes an exposure device 7Y to finish forming an electrostatic latent image to the photosensitive drum 1Y (finish forming an electrostatic latent image at Y-station) during the full-color printing operation (timing T100 (hereinafter, referred to as "T100")). In S102, the discharge timing determination section 120 determines whether or not the rotation number of the photosensitive drum 1Y (Y-station drum rotation number) at the Y station is equal to or larger than a predetermined threshold value of a condition for carrying out discharge. When the discharge timing determination section 120 determines in S102 that the Y-station drum rotation number is smaller than the threshold value, the discharge timing determination section 120 does not execute the discharge control and continues the printing operation. When the discharge timing determination section 120 determines in S102 that the Y-station drum rotation number is equal to or larger than the threshold value, the printer control section 101 starts the discharge operation.

In S103, as a preparation for detection of the reflected light from the discharge toner on the intermediate transfer belt 8, the printer control section 101 instructs the color deviation sensor LED emission section 113 to turn on the light emitting element 51 of the color deviation detection sensor 41 (T100). In S104, the printer control section 101 waits until the timing T101 at which an exposure device 7K finishes an operation for forming the electrostatic latent image to the transfer material P at the K station. In S105, the printer control section 101 starts the discharge execution section 121. In S105, the discharge execution section 121 instructs the exposure control section 112 to instruct the exposure devices 7 at all the color stations to simultaneously start forced light emission of an entire image area (all color laser exposure: ON). This light emission start timing is synchronized with the BD signal within the polygon scanner. If the forced light emission start timing at each station is an arbitrary timing in the main scan line, there is a fear that a color deviation corresponding to one line may occur between the stations to prevent the color deviation between the stations from being correctly detected, and hence the forced light emission is started in synchronization with the BD signal. In S106, the discharge execution section 121 performs the following processing when determining that a timing (T102) (light emission end timing) at which the exposure has been performed by a predetermined discharge toner width in a peripheral direction has been reached. That is, the discharge execution section 121 instructs the exposure control section 112 to instruct the exposure devices 7 at all the color stations to simultaneously end forced light emission of the entire image area (all color laser exposure: OFF). This end timing of the laser exposure is also synchronized with the BD signal within the polygon scanner. Note that in the discharge operation, an image having a lateral belt shape is exposed in a rotation direction (peripheral direction or circumferential direction) of the photosensitive drum 1 over an entire range of the width direction and visualized by the developing roller 3 to thereby create a toner image. As the developed image, a solid image (image having a maximum image density) is formed.

—Length Between Both Ends of the Discharge Toner Image—

Figure 5:
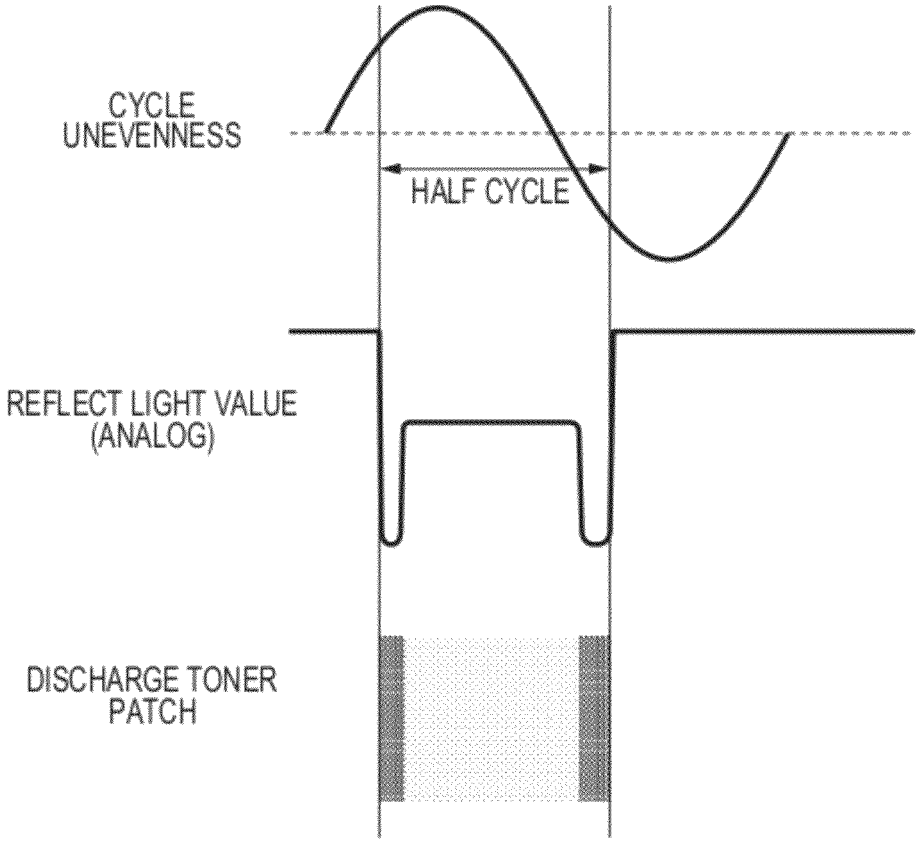
FIG. 5 is a relationship diagram between a discharge toner pattern and a speed cycle unevenness according to the first embodiment.

In this embodiment, the length of the discharge toner in the rotation direction of the intermediate transfer belt 8 is defined as follows. As already known, a cycle unevenness in speed of a roller related to carrying of the toner image affects a color deviation detection accuracy. In the construction according to this embodiment, the cycle unevenness in the speed of the photosensitive drum 1 affects the color deviation. Therefore, in this embodiment, as illustrated in FIG. 5, by setting the length between a leading edge and a trailing edge of the discharge toner image to a half-cycle length of rotational cycle unevenness of a rotary member (photosensitive drum 1) of interest, it is possible to cancel the cycle unevenness at any one of the leading edge and the trailing edge.

First, the developing roller 3 has a diameter of 12 mm and a cycle of approximately 37.68 mm. Further, the photosensitive drum 1 that affects the cycle unevenness has a diameter of 25 mm and a half cycle of approximately 39.25 mm. In order to prevent toner fusion, it is necessary to perform discharge for one round (one rotation cycle) of the developing roller 3. For this reason, here, the length of the discharge toner image is decided to be 39.25 mm (half rotation cycle of the electrophotosensitive member) corresponding to the half cycle of the photosensitive drum 1, which is longer than the cycle (one rotation cycle) of the developing roller 3. Accordingly, a time between an exposure start timing (T101) and an exposure end timing (T102) is approximately 218 (=39.25/180×1,000) msec. In this embodiment, for the sake of the construction according to the embodiment, the time is set to one half cycle of the cycle unevenness, but may be set to an odd multiple of the one half cycle which can cancel the cycle unevenness (odd multiple of the half rotation cycle of the electrophotosensitive member). In order to cancel the cycle unevenness in a color deviation detection value, the color deviation detection may be performed in a relationship of opposite phase, and detection results for color deviations may be averaged. A position in which the cycle unevenness exhibits an opposite phase with respect to a given color deviation detection point includes a position reached after progress of a half cycle and positions reached after further progress of integral multiples of one cycle. In other words, the positions of two points spaced apart from each other by a distance of an odd multiple of a half cycle are in the relationship of opposite phase in terms of the cycle unevenness, and by equalizing the color deviation detection results obtained in those positions, it is possible to cancel the cycle unevenness.

Subsequently, the discharge toner is transferred to the intermediate transfer belt 8. Up to now, an application bias to the primary transfer roller 6 is set to 0 V (second transfer bias). This is because the discharge toner is distributed and supplied to the cleaning blade 4 for the photosensitive drum 1 and the transfer belt cleaning blade 21 for the intermediate transfer belt 8. That is, assuming that the primary transfer bias is 0 V, half of the toner amount remains on the photosensitive drum 1, and half of the toner amount is transferred onto the intermediate transfer belt 8. Note that in order to prevent the toner traveling toward the transfer belt cleaning blade 21 from staining the secondary transfer roller 11, a secondary transfer bias having a negative polarity is applied between the secondary transfer roller 11 and the secondary transfer opposing roller 10 during the discharge operation. However, assuming that a transfer bias is set to 0 V as in a conventional technology, the density of the discharge toner on the intermediate transfer belt 8 decreases, and an accurate position of the toner image cannot be detected by the color deviation detection sensor 41. Therefore, in this embodiment, the primary transfer bias (first transfer bias) during the printing in which a transfer efficiency with respect to the intermediate transfer belt 8 is a predetermined transfer efficiency is applied only to both edge portions (predetermined area parts), in other words, the leading edge and the trailing edge, of the discharge toner. This allows the discharge toner position to be detected by the color deviation detection sensor 41. In S105 and S106, the electrostatic latent image of the discharge toner formed on the photosensitive drum 1 by the exposure device 7 is developed with toner by the developing roller 3, and the leading edge of the toner image reaches a primary transfer portion that is a nip portion between the photosensitive drum 1 and the primary transfer roller 6. When the printer control section 101 determines in S107 that 100 msec before the timing to reach the leading edge (leading edge of the patch) (T103) has been reached, the printer control section 101 performs the following processing. That is, the printer control section 101 causes the primary transfer bias control section 111 to apply to all the stations (turn on) the primary transfer bias for transferring the toner image onto the intermediate transfer belt 8 (all color primary transfer bias: ON). Note that a startup time of the primary transfer bias power source according to this embodiment is 50 msec, and the primary transfer bias may be started up at a timing preceding by a time larger than the startup time. That is, the primary transfer bias is previously started up so as to prevent the edge of the discharge toner from being affected.

When the printer control section 101 determines in S108 that a timing (T104) at which the leading edge of the discharge toner image has been transferred onto the intermediate transfer belt 8 by a length of 5 mm in the rotation direction has been reached, the printer control section 101 performs the following processing. That is, the printer control section 101 causes the primary transfer bias control section 111 to set to 0 V (turn off) the primary transfer bias (all color primary transfer bias: OFF). Note that the timing (T104) at which the leading edge of the discharge toner image has been transferred onto the intermediate transfer belt 8 by the length of 5 mm is set as the timing at which the primary transfer bias control section 111 sets the primary transfer bias to 0 V because a measurement spot of the color deviation detection sensor 41 is 5 mm. Note that at T104, the primary transfer bias is set to 0 V outside the both edge portions (predetermined area parts) of the leading edge and the trailing edge of the discharge toner, but the present invention is not limited thereto. In a situation in which the toner supply for preventing the transfer belt cleaning blade 21 from chattering against the intermediate transfer belt 8 is unnecessary, the primary transfer bias set to 0 V may be changed to a bias having a negative polarity. In this case, substantially all the toner images outside the both edge portions return to a photosensitive drum side. Further, in contrast, in a situation in which the amount of toner supplied to the transfer belt cleaning blade 21 for the intermediate transfer belt 8 is to be increased, a weak bias having a positive polarity may be applied as the primary transfer bias, and a toner distribution ratio with respect to the photosensitive drum 1 and the intermediate transfer belt 8 may be changed as necessary. The description is directed to the case of causing the primary transfer bias control section 111 to set to 0 V (turn off) the primary transfer bias, but the present invention is not limited thereto, and has a feature that a transfer bias (second transfer bias) whose transfer efficiency is at least smaller than the first transfer bias during the printing is applied.

When the printer control section 101 determines in S109 that a timing (T105) approximately 78 msec before the timing at which the trailing edge of the discharge toner image (trailing edge of the patch) reaches the primary transfer roller 6 has been reached, the printer control section 101 performs the following processing. That is, the printer control section 101 causes the primary transfer bias control section 111 to again apply (turn on) the primary transfer bias during the printing (all color primary transfer bias: ON). Note that the timing T105 is a timing preceding by a time corresponding to a measurement spot of 5 mm of the color deviation detection sensor 41 and the startup time of the primary transfer bias, in other words, a timing preceding by approximately 78 (=5/180×1,000+50) msec. In S110, at a time point (T106) at which the transfer of the discharge toner is finished, the printer control section 101 causes the primary transfer bias control section 111 to turn off the primary transfer bias (all color primary transfer bias: OFF).

Figure 6:
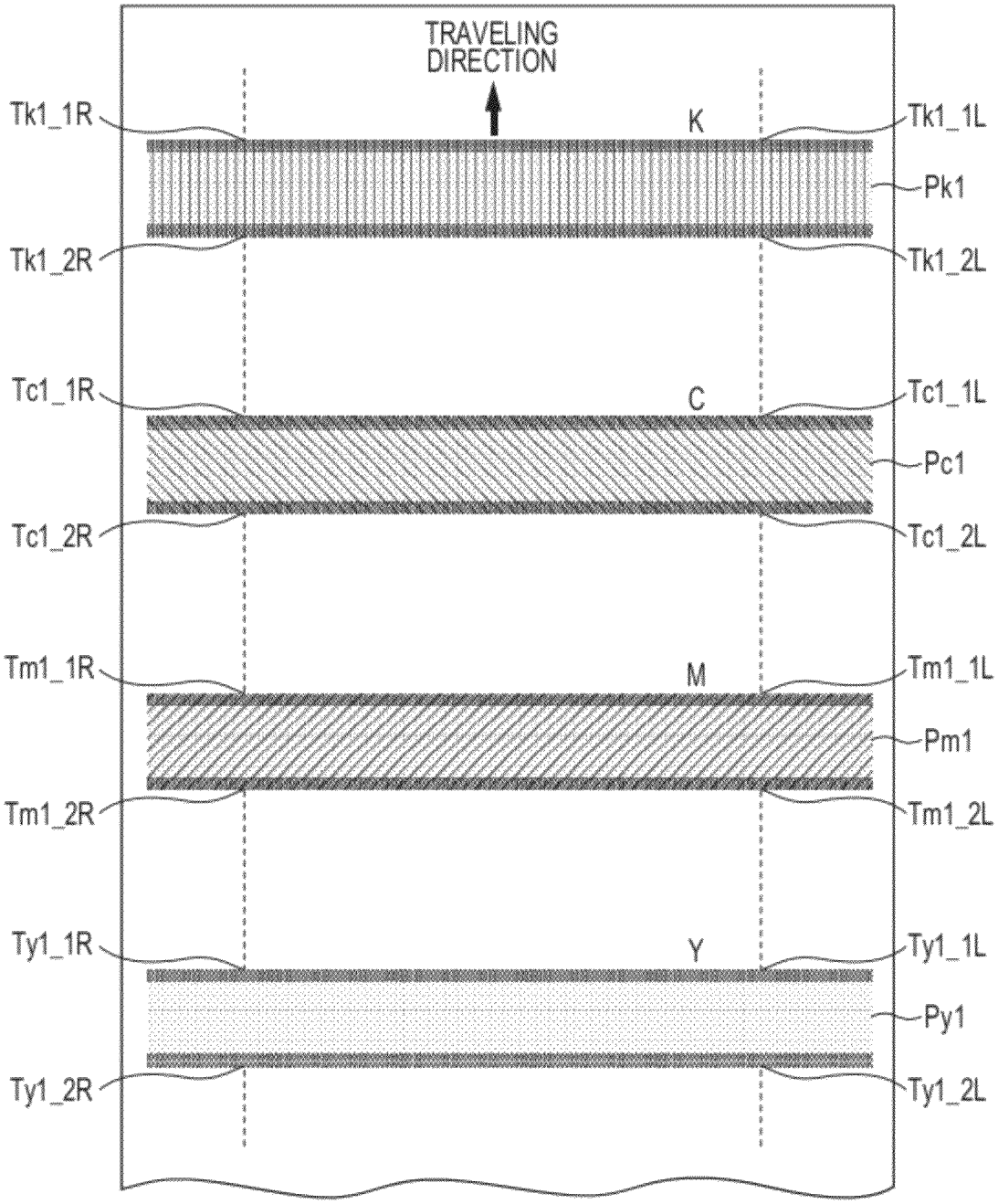
FIG. 6 is a diagram illustrating the discharge toner pattern transferred onto an intermediate transfer belt according to the first embodiment.

As described above, the printer control section 101 controls the primary transfer bias to thereby enable the color deviation detection sensor 41 to detect the discharge toner. Further, it is possible to supply the toner as a lubricant to the cleaning blade 4 for the photosensitive drum 1 and the transfer belt cleaning blade 21 for the intermediate transfer belt 8. Note that it is confirmed that effects against the problem of the curling up of the blade or other such problems have been achieved, while the toner amount supplied to the cleaning blade 4 for the photosensitive drum 1 is reduced compared to the conventional technology. The discharge toner of the respective colors according to this embodiment forms such a pattern as illustrated in FIG. 6 on the intermediate transfer belt 8. Discharge toner patches Pk1, Pc1, Pm1, and Py1 of the respective colors exhibit such a pattern as to be transferred onto the intermediate transfer belt 8 with a high density only in the both edge portions (predetermined area parts) and with a low density in a central portion (part excluding the predetermined area parts).

Note that with regard to pattern of FIG. 6, a blank part in which no toner image is formed is also provided at least on the photosensitive drum 1 adjacently to the toner image on the photosensitive drum corresponding to an area to which the primary transfer bias (first transfer bias) during the printing is applied. This is for primarily transferring the toner image onto the belt after the startup of the primary transfer bias performed in S107 and S109 as described above is finished to create a state in which the primary transfer bias is stably applied. This also applies to each of embodiments described later.

After causing the discharge execution section 121 to form discharge toner patches of the respective colors, the printer control section 101 causes the color deviation detection sensor 41 to detect a passage timing of the discharge toner. In S111, the discharge execution section 121 uses the color deviation sensor interruption control section 122 to detect passage timings of the leading edge and the trailing edge of the discharge toner of the respective colors based on a change of a digital signal obtained by binarizing the reflected light value of the light receiving element 52 of the color deviation detection sensor 41. The respective timings are as illustrated in FIG. 4, and are also illustrated in FIG. 6. In other words, the reference symbols starting with "T" which are indicated in FIG. 6 denote detection timings of the discharge toner detected by the color deviation detection sensor 41, and the suffixes "R" and "L" represent which of the color deviation detection sensors 41R and 41L is used for the detection. Note that in the timing chart of FIG. 4, a logic of the digital signal changes only at both edges of the discharge toner. However, the central portion of the discharge toner transferred with the primary transfer bias of 0 V has a low density, and hence the reflected light is unstable, which may change the digital signal in the central portion. In that case, the change of the digital signal may be masked outside the vicinities of theoretical timings at which the leading edge and the trailing edge of the discharge toner reach the color deviation detection sensor 41. That is, only the timings of the leading edge and the trailing edge can be extracted unless the color deviation sensor interruption control section 122 is started.

In S112, the discharge execution section 121 makes the color deviation sensor LED emission section 113 turn off the light emitting element 51 of the color deviation detection sensor 41 at a timing (T110) at which the passage timings of all the colors have been detected without fail. In S113, in order to clean up the toner on the intermediate transfer belt 8, the discharge execution section 121 subjects the intermediate transfer belt 8 to idling rotation for a time necessary for the discharge toner to pass through the transfer belt cleaning blade 21 twice. The intermediate transfer belt 8 is subjected to the idling rotation because the residual toner on the intermediate transfer belt 8 is cleaned up without fail after the discharge toner formation. After the cleaning of the intermediate transfer belt performed in S113 is finished, in S114, a discharge color deviation calculation section 125 calculates a sub-scanning direction color deviation amount according to the following procedure.

—Calculation of Sub-Scanning Direction Color Deviation Amount—

In this embodiment, the start and the end of the exposure are simultaneously carried out at all the color stations, and hence timings at which the discharge toner patches of the respective colors pass through the color deviation detection sensor 41 are shifted from each other by approximately a distance between the stations. A theoretical difference from the distance between the stations can be assumed as the color deviation from a theoretical writing position, and by comparing the difference with the results of the color deviation correction control, it is possible to calculate the color deviation at a time point at which the discharge control is carried out.

Hereinafter, the method of color deviation calculation is described. First, the middle point of the discharge toner of each color is calculated.

$$Tk1R=(Tk1_1R+Tk1_2R)/2 \quad \text{[Ex. 1]}$$

$$Tc1R=(Tc1_1R+Tc1_2R)/2 \quad \text{[Ex. 2]}$$

$$Tm1R=(Tm1_1R+Tm1_2R)/2 \quad \text{[Ex. 3]}$$

$$Ty1R=(Ty1_1R+Ty1_2R)/2 \quad \text{[Ex. 4]}$$

Then, the resultants are converted in terms of Y, which is the reference color for the sub-scanning direction color deviation.

$$Tk_yR=Ty1R-Tk1R \quad \text{[Ex. 5]}$$

$$Tc_yR=Ty1R-Tc1R \quad \text{[Ex. 6]}$$

$$Tm_yR=Ty1R-Tm1R \quad \text{[Ex. 7]}$$

As the image forming apparatus of this embodiment is 600 dpi, the time per line is [ms]=1 (inch)/600/180×1000≈0.235185, and the number of lines is changed based on this time.

$$YkR[\text{line}]=Tk_yR/(\text{time per line}) \quad \text{[Ex. 8]}$$

$$YcR[\text{line}]=Tc_yR/(\text{time per line}) \quad \text{[Ex. 9]}$$

$$YmR[\text{line}]=Tm_yR/(\text{time per line}) \quad \text{[Ex. 10]}$$

Up to this point, because the calculated value is that of one side of the color deviation detection sensor 41R, the results of the calculation of both sides is averaged.

$$Yk[\text{line}]=(YkR[\text{line}]+YkL[\text{line}])/2 \quad \text{[Ex. 11]}$$

$$Yc[\text{line}]=(YcR[\text{line}]+YcL[\text{line}])/2 \quad \text{[Ex. 12]}$$

$$Ym[\text{line}]=(YmR[\text{line}]+YmL[\text{line}])/2 \quad \text{[Ex. 13]}$$

Further, when the printer control portion 101 notifies the controller 103 via the color deviation correction control, each of the number of writing lines in the sub-scanning direction in terms of Y is Lk[line], Lc[line], and Lm[line], and the amount of color deviation of each color compared to at the time of color deviation correction control is:

$$Rk[\text{line}]=Yk[\text{line}]-Lk[\text{line}] \quad \text{[Ex. 14];}$$

$$Rc[\text{line}]=Yc[\text{line}]-Lc[\text{line}] \quad \text{[Ex. 15]; and}$$

$$Rm[\text{line}]=Ym[\text{line}]-Lm[\text{line}] \quad \text{[Ex. 16].}$$

Then, the discharge color deviation calculation section 125 notifies a color deviation correction execution determination section 124 of calculation results. In S115, the color deviation correction execution determination section 124 determines whether or not the sub-scanning direction color deviation amount of each color is equal to or larger than a predetermined threshold value. When the color deviation correction execution determination section 124 determines in S115 that the sub-scanning direction color deviation amount of each color is equal to or larger than the predetermined threshold value, that is, that execution of the color deviation correction control is necessary, in S116, the color deviation correction execution determination section 124 requests the controller 103 to execute the color deviation correction control, and a color deviation correction control execution section 123 performs the color deviation correction control. The color deviation correction control execution section 123 forms a test pattern image different from the toner discharge on the intermediate transfer belt 8, and performs known color deviation correction control based on the results from detecting the test pattern image. Note that the test pattern image formed in S116 is not described in detail, but is a test pattern image which exhibits a pattern created separately at least from the toner patterns illustrated in FIGS. 6, 9, and 11 and of which the number of toner patches is larger than those of FIGS. 6, 9, and 11. Further, the color deviation correction control executed here is the same as the color deviation correction control described above as a known technology, and detailed description thereof is omitted here.

On the other hand, when the color deviation correction execution determination section 124 determines in S115 that the sub-scanning direction color deviation amount of each color is smaller than the predetermined threshold value, that is, that the execution of the color deviation correction control is unnecessary, the discharge control is brought to an end, and a printer operation is continued. In this embodiment, the threshold value of the sub-scanning direction color deviation amount is set to 3 (lines) as an example. Note that when the color deviation correction execution determination section 124 determines in S115 that the execution of the color deviation correction control is unnecessary, correction setting may be performed to correct the laser beam light emitting timing being the image forming condition based on the color deviation amount operated in S114.

Figure 7:
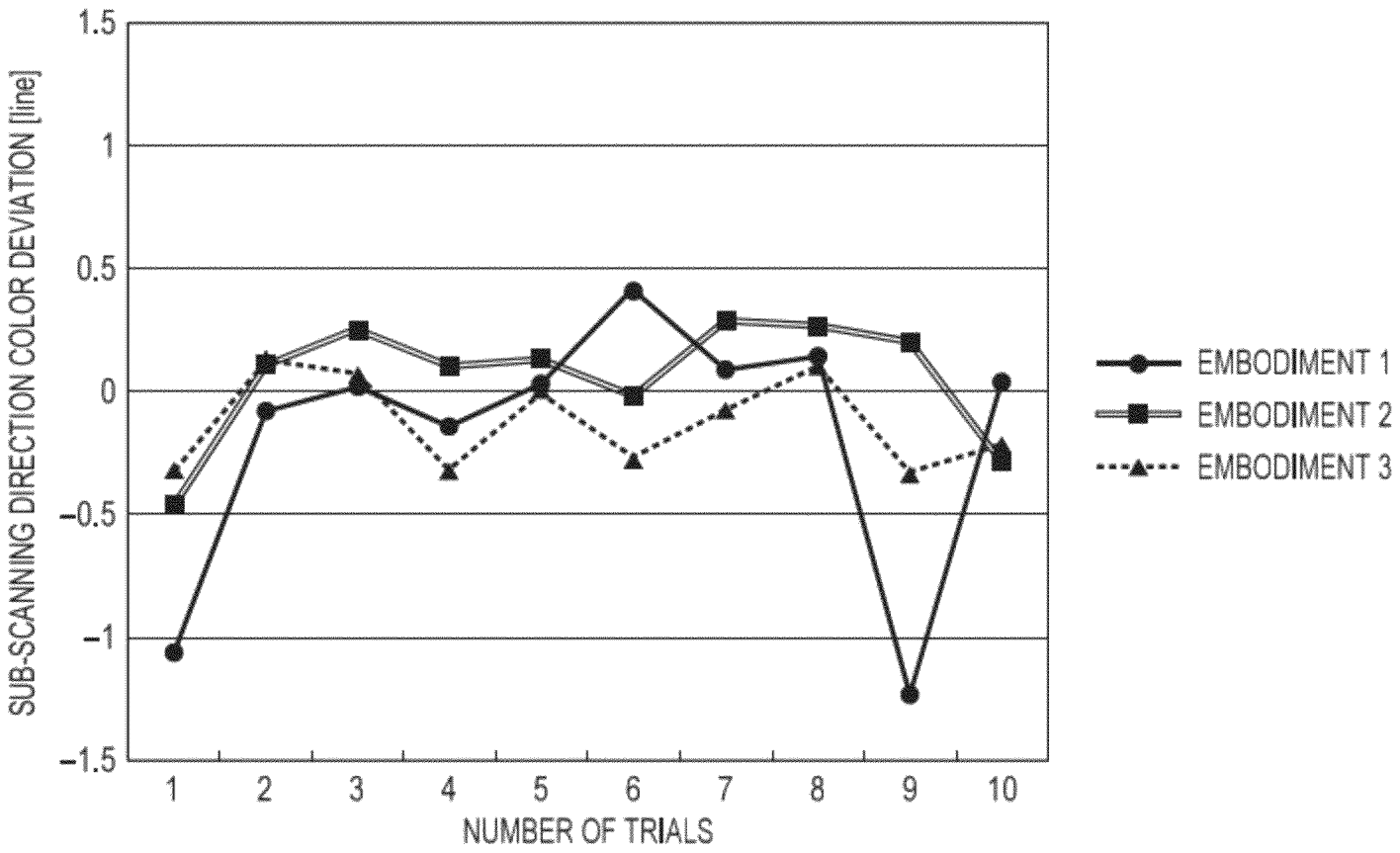
FIG. 7 is a graph of detection results of sub-scanning direction color deviation control performed in the discharge control according to the first to third embodiments.

In order to confirm stability of detection accuracy of the sub-scanning direction color deviation using the discharge toner according to this embodiment, the color deviation correction control→the color deviation detection using the discharge toner are repeatedly executed times, and FIG. 7 illustrates the color deviation detection results for the sub-scanning direction as data indicated by points of black circle marks. In FIG. 7, numerical values 1 to 10 represent the numbers of trials. Based on the color deviation information detected in this embodiment, the printer control section 101 may change the number of writing lines in the sub-scanning direction in terms of Y of which the controller 103 is to be notified. However, in the detection results obtained in this embodiment, the number of toner patches is smaller than in the color deviation correction control, and hence the color deviation detection accuracy is low. In view of the results, the color deviation detection results are reflected on the execution timing of the color deviation correction control instead of being reflected on the writing position.

As described above, according to this embodiment, it is possible to perform the color deviation detection by using the discharge toner. By reflecting the color deviation detection results on the execution timing of the color deviation correction control, the color deviation correction control can be executed at a more appropriate timing than the conventional technology, and it is possible to reduce the execution frequency of the color deviation correction control. Further, in contrast, in a case of an abrupt occurrence of the color deviation, a request for the color deviation correction control can be made after detecting the color deviation, and hence it is also possible to suppress the color deviation. Further, it is possible to achieve the original object of the discharge control, that is, the object to prevent the toner fusion of the developing roller 3 and to supply toner to the cleaning blade 4 for the photosensitive drum 1 and the transfer belt cleaning blade 21. Further, the color deviation can be detected within a time of the original discharge, and hence the color deviation can be detected without newly extending a user's waiting time. That is, according to this embodiment, the toner consumed in the toner discharge can be effectively used as, for example, the toner image involved in the color deviation detection. This leads to the reduction of the execution frequency of the color deviation correction control.

(Second Embodiment)

A construction of an image forming apparatus according to a second embodiment and a schematic configuration of a control system thereof are the same as those of the first embodiment. Therefore, description thereof is omitted, and the following description is made by using the same reference symbols. The first embodiment describes the case where the focus is placed on the cycle unevenness of the photosensitive drum 1. However, the actual image forming apparatus may be affected by the cycle unevenness of the drive roller 9 (second rotary member) in addition to the photosensitive drum 1 (first rotary member) as the cycle unevenness that affects the color deviation detection results. In this embodiment, a construction and configuration that can also cancel the cycle unevenness of the drive roller 9 is proposed. Note that, the present invention is not limited to the photosensitive drum 1 and the drive roller 9 as the cycle unevennesses of interest, and the embodiment may be targeted at the rotary member involved in various kinds of image forming that exerts a cycle unevenness exhibiting a given cycle.

(Fine Patch)

Figure 8:
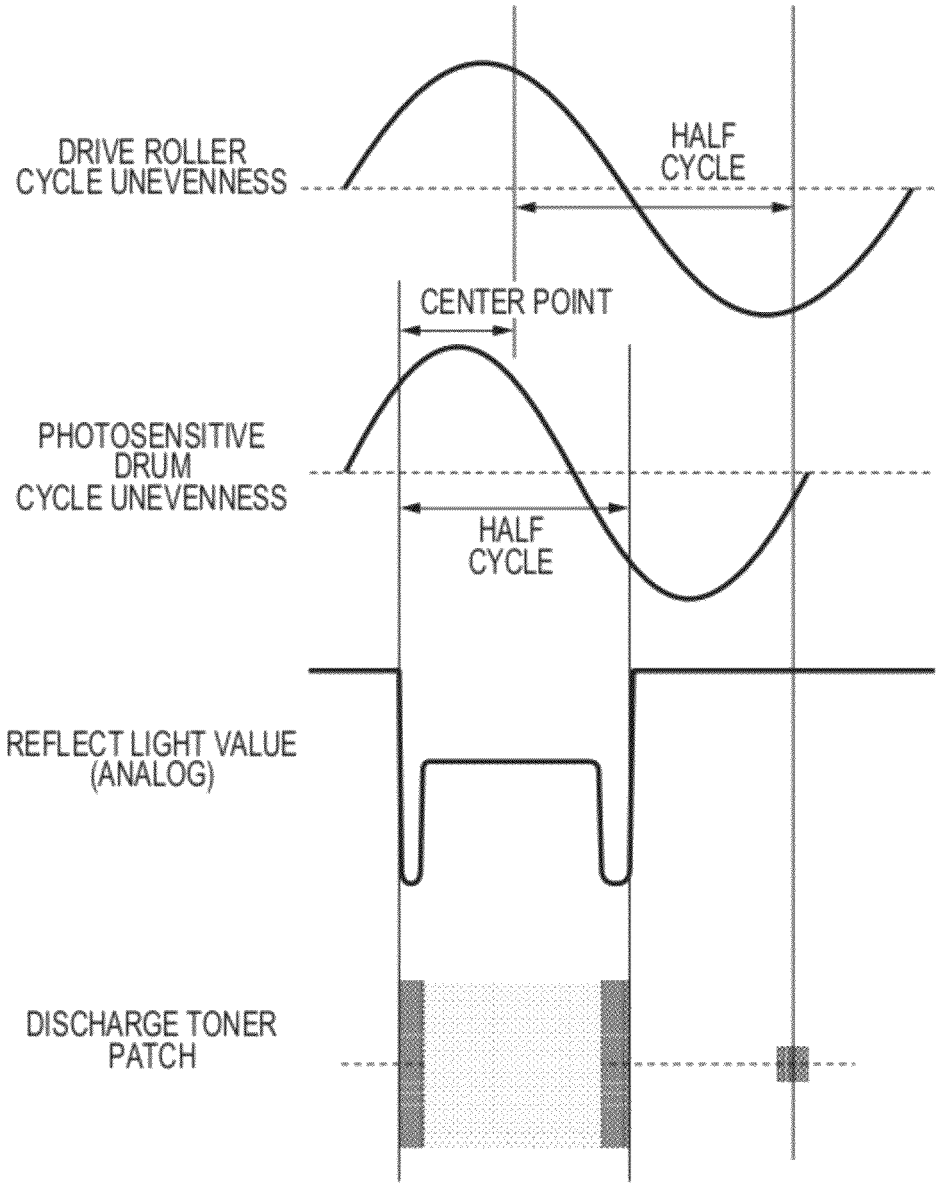
FIG. 8 is a relationship diagram between a discharge toner pattern and speed cycle unevennesses of a photosensitive drum and a drive roller of an intermediate transfer belt according to the second embodiment.

In this embodiment, as illustrated in FIG. 8, in addition to the discharge toner (first toner image) according to the first embodiment, a fine patch (second toner image) is developed in such a position as to be able to cancel the cycle unevenness of the drive roller 9. The fine patch is located so that a middle point of the fine patch coincides with a position spaced apart from a middle point of the discharge toner by 47.1 mm being a half cycle of the drive roller 9 (half rotation cycle of a drive unit for driving a belt). Then, a length of the fine patch in the transport direction is set to 5 mm being a measurement spot diameter of the color deviation detection sensor 41, and the length in a longitudinal direction thereof is set to 10 mm in consideration of a case where a main scanning direction color deviation becomes largest.

Figure 9:
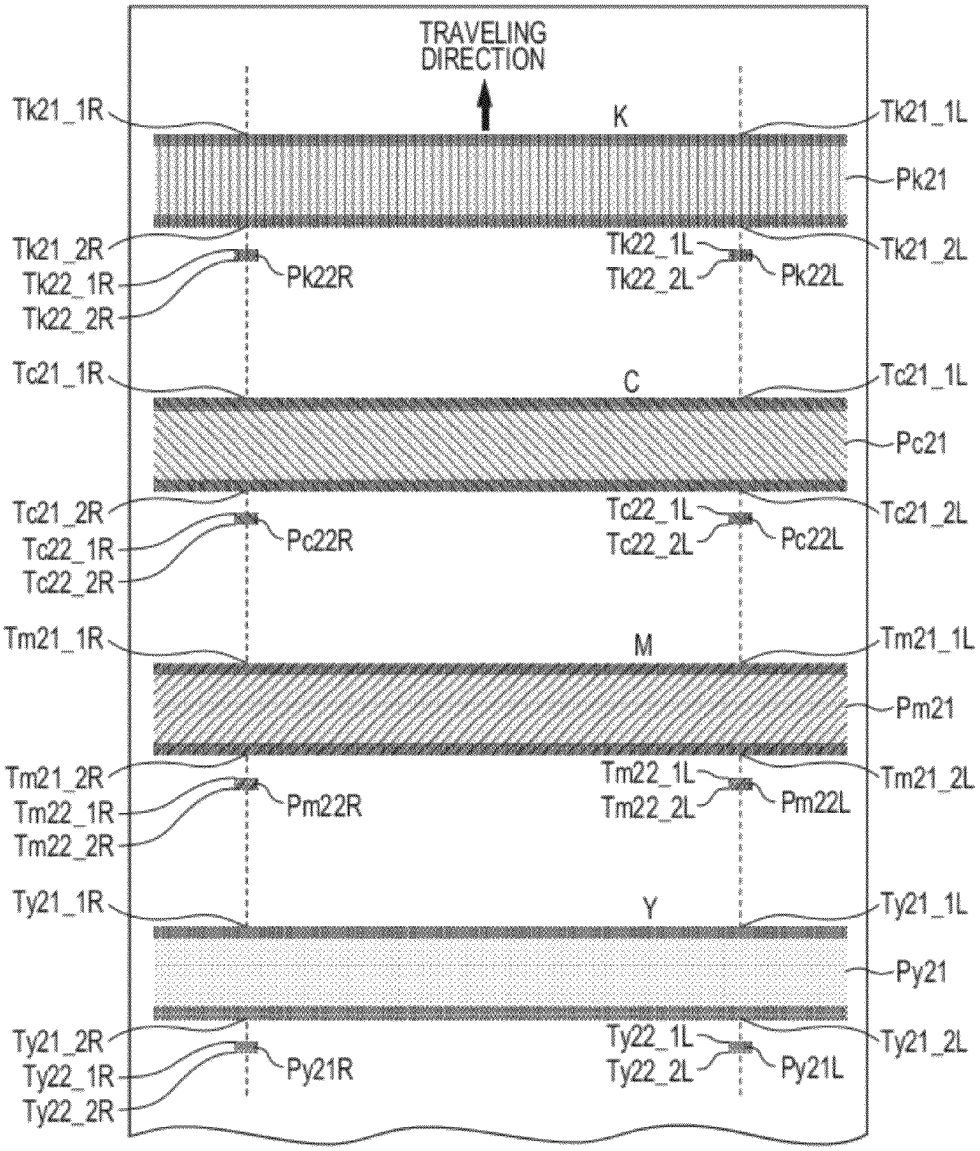
FIG. 9 is a diagram illustrating the discharge toner pattern transferred onto the intermediate transfer belt according to the second embodiment.

In the same manner as the leading edge and the trailing edge of the discharge toner, the fine patch is transferred onto the intermediate transfer belt 8 by the primary transfer bias during the printing, and has the passage timing detected by the color deviation detection sensor 41. The discharge pattern on the intermediate transfer belt 8 according to this embodiment is such a pattern as illustrated in FIG. 9. That is, the discharge pattern according to this embodiment is formed of discharge toner patches Pk21, Pc21, Pm21, and Py21 and fine patches Pk22R, Pk22L, Pc22R, Pc22L, Pm22R, Pm22L, Py21R, and Py21L. Of those, by taking the case of black (K) as an example, parts transferred onto the intermediate transfer belt 8 with a high density are the leading edge (first predetermined area part) and the trailing edge (second predetermined area part) of the discharge toner patch Pk21 and the fine patches Pk22R and Pk22L (third predetermined area parts). The reference symbols starting with "T" which are indicated in FIG. 9 denote detection timings of the discharge toner detected by the color deviation detection sensor 41. The timing chart at the time of the discharge is the same as that of the first embodiment, and is therefore omitted.

Note that, in this embodiment, each of parts of the discharge toner patches Pk21, Pc21, Pm21, and Py21 which are transferred onto the intermediate transfer belt 8 with a low density is formed as a continuous area, but the part transferred with a low density may be formed as a non-continuous area. That is, the part transferred with a low density may be provided with a blank portion. In addition, the blank portion may be provided at regular intervals or at irregular intervals. In this embodiment, in order to detect the cycle unevennesses of the photosensitive drum 1 and the drive roller 9, a length in the loop direction from the leading edge of the discharge toner patch to the fine patch is equal to or longer than a length corresponding to one cycle of the developing roller 3. However, the discharge toner corresponding to one cycle of the developing roller 3 suffices in the discharge control. Therefore, by forming the part in which the discharge toner patch is transferred with a low density as the non-continuous area to thereby reduce the toner amount, it is possible to perform the discharge control with a minimum toner amount while detecting the color deviation amount. In addition, in order to cancel the cycle unevennesses of the photosensitive drum 1 and the drive roller 9, the interval for the discharge toner in the loop direction is set to one half cycle of the cycle unevenness, but may be set to an odd multiple or a substantially odd multiple of the one half cycle which can cancel the cycle unevenness.

(Calculation of Sub-Scanning Direction Color Deviation Amount)

The discharge color deviation calculation section 125 calculates the color deviation from the discharge toner pattern and the fine patch detection timing. First, the middle point is calculated from each color of discharge toner.

$$Tk21R=(Tk21_1R+Tk21_2R)/2 \quad \text{[Ex. 17]}$$

$$Tc21R=(Tc21_1R+Tc21_2R)/2 \quad \text{[Ex. 18]}$$

$$Tm21R=(Tm21_1R+Tm21_2R)/2 \quad \text{[Ex. 19]}$$

$$Ty21R=(Ty21_1R+Ty21_2R)/2 \quad \text{[Ex. 20]}$$

Next, the middle point of the fine patch is calculated.

$$Tk22R=(Tk22_1R+Tk22_2R)/2 \quad \text{[Ex. 21]}$$

$$Tc22R=(Tc22_1R+Tc22_2R)/2 \quad \text{[Ex. 22]}$$

$$Tm22R=(Tm22_1R+Tm22_2R)/2 \quad \text{[Ex. 23]}$$

$$Ty22R=(Ty22_1R+Ty22_2R)/2 \quad \text{[Ex. 24]}$$

The results of the discharge toner and the fine patch are averaged.

$$Tk2R=(Tk21R+Tk22R)/2 \quad \text{[Ex. 25]}$$

$$Tc2R=(Tc21R+Tc22R)/2 \quad \text{[Ex. 26]}$$

$$Tm2R=(Tm21R+Tm22R)/2 \quad \text{[Ex. 27]}$$

$$Ty2R=(Ty21R+Ty22R)/2 \quad \text{[Ex. 28]}$$

After averaging, the resultants are converted in terms of Y, which is the reference color for the sub-scanning direction color deviation.

$$Tk_yR=Ty2R-Tk2R \quad \text{[Ex. 29]}$$

$$Tc_yR=Ty2R-Tc2R \quad \text{[Ex. 30]}$$

$$Tm_yR=Ty2R-Tm2R \quad \text{[Ex. 31]}$$

Then, the discharge color deviation calculation section 125 uses expressions 8 to 16 of the first embodiment to calculate sub-scanning direction color deviations Rk (lines), Rc (lines), and Rm (lines) of the respective colors.

In order to confirm stability of detection accuracy of the sub-scanning direction color deviation using the discharge toner according to this embodiment, the color deviation correction control→the color deviation detection using the discharge toner are repeatedly executed 10 times, and FIG. 7 illustrates the color deviation detection results for the sub-scanning direction as data indicated by points of black square marks. Compared with the first embodiment, it is confirmed that the stability of the detection accuracy is improved to fall within ±0.5 lines. Therefore, the execution timing of the color deviation correction control can be determined more accurately than in the first embodiment. Further, the toner amount of the added fine patches is small enough to keep an influence on the user to a small level.

As described above, according to this embodiment, the toner consumed in the toner discharge can be effectively used as, for example, the toner image involved in the color deviation detection. This leads to the reduction of the execution frequency of the color deviation correction control.

(Third Embodiment)

A construction of an image forming apparatus according to a third embodiment of the present invention and a schematic configuration of a control system thereof are the same as those of the first embodiment. Therefore, description thereof is omitted, and the description is made by using the same reference symbols. The second embodiment describes the construction and configuration that enable the color deviation to be detected during the discharge control with more accurately with the addition of the discharge toner and the fine patch. However, more toner is consumed than in normal discharge control due to the addition of the fine patch for the above-mentioned purpose. This embodiment describes a construction and configuration that can cancel the cycle unevennesses of the photosensitive drum 1 and the drive roller 9 while keeping the consumption amount of toner to a lower level than in the discharge control.

(Discharge Toner Patch)

Figure 10:
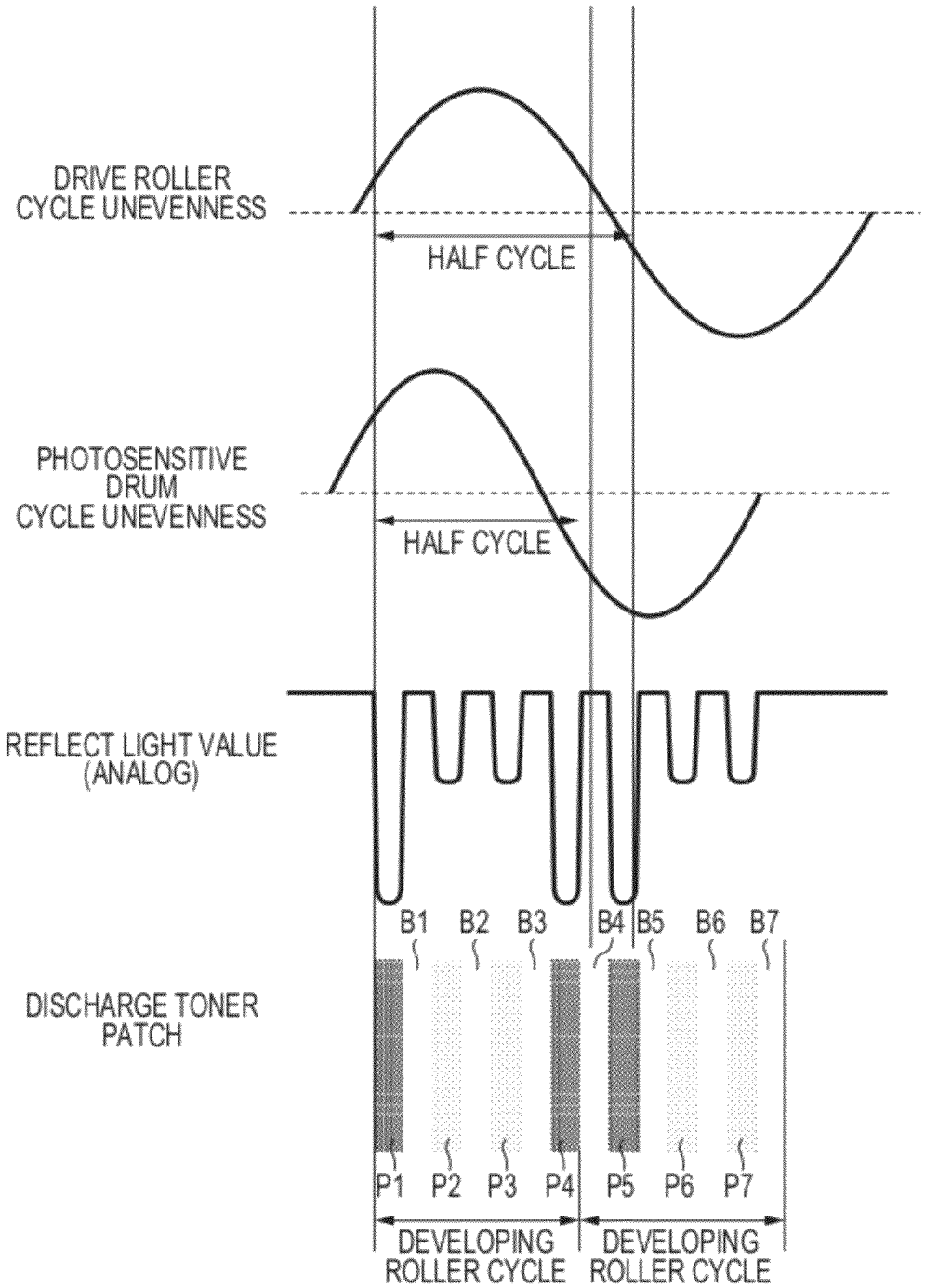
FIG. 10 is a relationship diagram between a discharge toner pattern and speed cycle unevennesses of a photosensitive drum and a drive roller of an intermediate transfer belt according to the third embodiment.

In this embodiment, instead of being formed as one lateral belt, as illustrated in FIG. 10, the discharge toner is formed so that repetitions of lateral belts are located within a range having a length of two rounds of the developing roller. Further, the discharge toner is formed so that, within the length of the second round of the developing roller, the lateral belt is located in a blank space that has been formed within the length of the first round of the developing roller.

Specifically, in the toner patch according to this embodiment, lateral belts P1 to P7 illustrated in FIG. 10 each have a length of 5.38 mm in the transport direction (length L in the rotation direction) and a width of the entire range in the longitudinal direction in the same manner as the discharge toner. The length L in the rotation direction is set to a value obtained by dividing the cycle of the developing roller 3 by 7 which is larger than the measurement spot diameter of the color deviation detection sensor 41 being 5 mm and the smallest quotient among those obtained by dividing the cycle of the developing roller 3 being approximately 37.68 mm by an integer. Further, blank portions (blanks) B1 to B7 each following the patch have the same length in the transport direction as the length of the patch. The patches P1, P2, P3, and P4 and the blank portions B1, B2, and B3 are located within the length of the first round of the developing roller, and the patch and the blank portion are repeatedly formed. Within the length of the second round of the developing roller, the patches P5, P6, and P7 are located in areas that have been formed as the blank portions in the first round of the developing roller, and the blank portions B4, B5, B6, and B7 are located in areas in which the patches have been located in the first round of the developing roller.

The discharge execution section 121 selects which of the patches to cause the primary transfer bias control section 111 to apply the primary transfer bias to and normally transfer onto the intermediate transfer belt 8. First, assuming that the leading patch P1 is transferred, the patch having a distance from P1 closest to a half cycle of the photosensitive drum 1 being 39.25 mm is P4, and the patch having the distance closest to a half cycle of the drive roller 9 being 47.1 mm is P5. Accordingly, the discharge execution section 121 is set to cause the patches P1, P4, and P5 to be normally transferred onto the intermediate transfer belt 8. With this arrangement, it is possible to discharge all the toner existing on the periphery of the developing roller, and it is also possible to substantially cancel the cycle unevennesses of the photosensitive drum 1 and the drive roller 9 in the color deviation detection.

Figure 11:
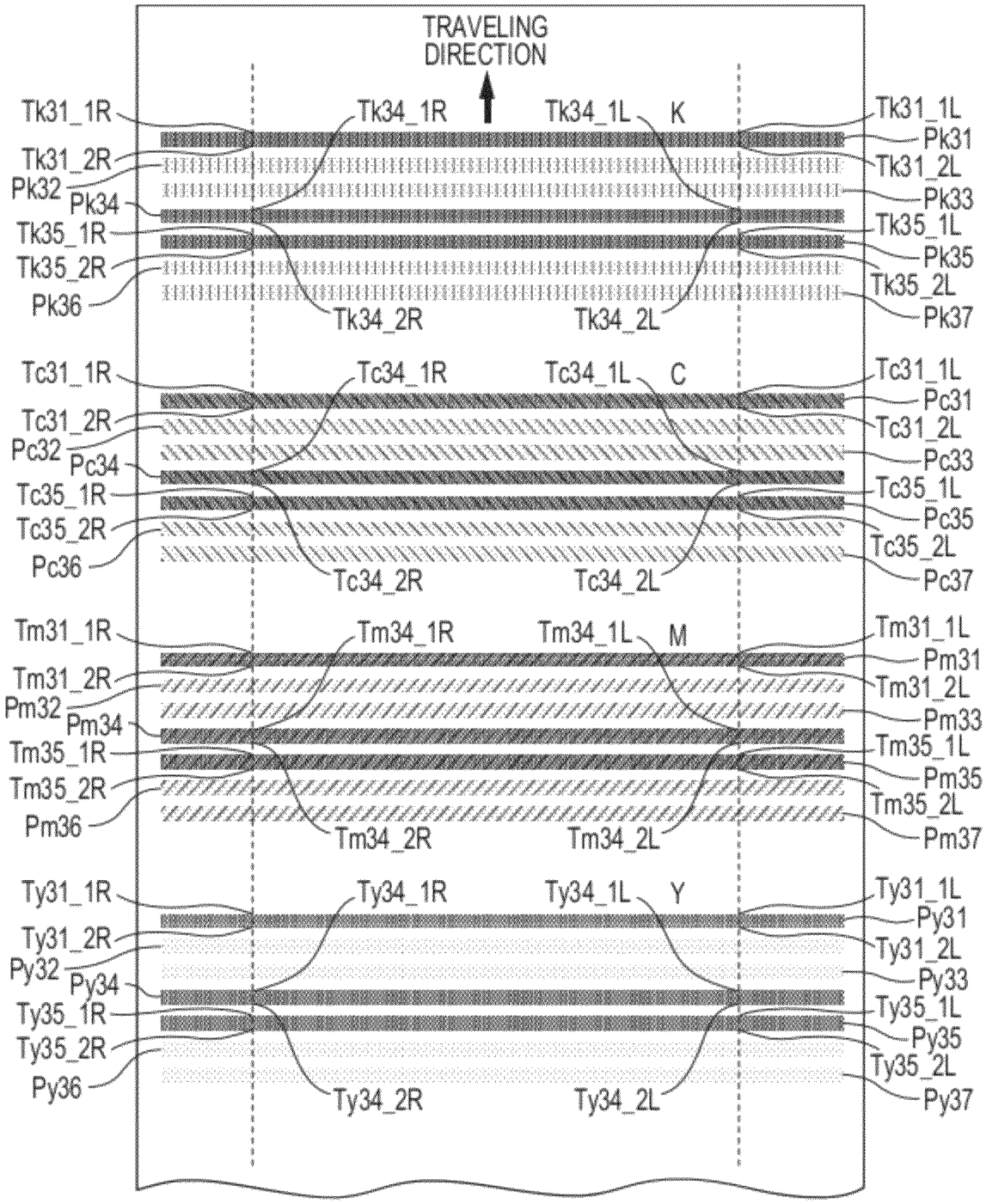
FIG. 11 is a diagram illustrating the discharge toner pattern transferred onto the intermediate transfer belt according to the third embodiment.

The discharge pattern on the intermediate transfer belt 8 according to this embodiment is as illustrated in FIG. 11. That is, discharge pattern according to this embodiment is formed of discharge toner patches Pk31 to Pk37, Pc31 to Pc37, Pm31 to Pm37, and Py31 to Py37. Of those, by taking the case of black (K) as an example, parts transferred onto the intermediate transfer belt 8 with a high density are the discharge toner patch Pk31 (first predetermined area part), the discharge toner patch Pk34 (second predetermined area part), and the discharge toner patch Pk35 (third predetermined area part). The discharge execution section 121 uses the color deviation detection sensor 41 to detect the passage timings of the leading edges and the trailing edges of the first, the fourth, and the fifth patches among the patches of the respective colors. The reference symbols starting with "T" which are indicated in FIG. 11 denote detection timings of the discharge toner detected by the color deviation detection sensor 41.

Note that, in this embodiment, if a focus is placed on the part transferred onto the intermediate transfer belt 8 with a high density, for example, the discharge toner patch P4, the blank portions B3 and B4 are formed to be arranged on both sides thereof, but a blank part may be provided at least one of before and after the discharge toner patch P4 in the loop direction. This is because the edge of the toner patch can be detected by the color deviation detection sensor 41 if a blank portion is formed on at least one side of the part transferred with a high density. Further, the blank portions are provided at the same intervals as the discharge toner patches, but may be provided at different intervals therefrom. In this embodiment, the discharge toner is formed so that a total length of the discharge toner becomes a length corresponding to the two rounds of the developing roller 3, but the discharge toner corresponding to one round of the developing roller 3 at minimum suffices in order to perform the discharge control for the sake of the developing roller 3. However, in order to detect the cycle unevennesses of the photosensitive drum 1 and the drive roller 9, it is necessary to transfer the discharge toner patches P1, P4, and P5 (first to third predetermined area parts) in fixed positions with a high density. Therefore, the arrangement and intervals regarding the discharge toner patches P2, P3, P6, and P7 transferred onto the intermediate transfer belt 8 with a low density can be changed so that the total toner amount corresponds to one cycle of the developing roller 3, and are not limited to this embodiment. That is, the toner amount is set to correspond to one cycle of the developing roller 3 as a whole by reducing the toner amount of the part transferred onto the intermediate transfer belt 8 with a low density, and hence it is possible to perform the discharge control with a minimum toner amount while enabling the detection of the color deviation amount.

(Calculation of Amount of Sub-Scanning Direction Color Deviation)

The discharge color deviation calculation section 125 calculates the color deviation based on this timing. The discharge color deviation calculation section 125 calculates the middle point of each color of each patch. In the case where the K station patch is calculated:

$$Tk31R=(Tk31_1R+Tk31_2R)/2 \quad \text{[Ex. 32];}$$

$$Tk34R=(Tk34_1R+Tk34_2R)/2 \quad \text{[Ex. 33]; and}$$

$$Tk35R=(Tk35_1R+Tk35_2R)/2 \quad \text{[Ex. 34].}$$

All the color calculations are carried out in the same manner in the discharge color deviation calculation section 125, and the C station patch Tc31R, Tc34R, Tc35R, the M station patch Tm31R, Tm34R, Tm35R, and the Y station patch Ty31R, Ty34R, Ty35R are calculated.

Next, in order to cancel the speed unevenness (cycle unevenness) of the photosensitive drum 1, the discharge color deviation calculation section 125 averages the first patch and the fourth patch.

$$Tk314R=(Tk31R+Tk34R)/2 \quad \text{[Ex. 35]}$$

Further, in order to cancel the speed unevenness (cycle unevenness) of the drive roller 9, the discharge color deviation calculation section 125 averages the first patch and the fifth patch.

$$Tk315R=(Tk31R+Tk35R)/2 \quad \text{[Ex. 36]}$$

Further, the two pieces of data are averaged.

$$Tk3R=(Tk314R+Tk315R)/2 \quad \text{[Ex. 37]}$$

Calculation is performed on all colors, and the C station patch Tc3R, the M station patch Tm3R, and the Y station patch Ty3R are calculated. After averaging, the resultants are converted in terms of Y, which is the reference color for the sub-scanning direction color deviation.

$$Tk_yR=Ty3R-Tk3R \quad \text{[Ex. 38]}$$

$$Tc_yR=Ty3R-Tc3R \quad \text{[Ex. 39]}$$

$$Tm_yR=Ty3R-Tm3R \quad \text{[Ex. 40]}$$

The discharge color deviation calculation section 125 uses expressions 8 to 16 of the first embodiment to calculate sub-scanning direction color deviations Rk (lines), Rc (lines), and Rm (lines) of the respective colors.

In order to confirm stability of detection accuracy of the sub-scanning direction color deviation using the discharge toner according to this embodiment, the color deviation correction control→the color deviation detection using the discharge toner are repeatedly executed times, and FIG. 7 illustrates the color deviation detection results for the sub-scanning direction as data indicated by points of black triangle marks. The stability is substantially the same as in the second embodiment. The execution timing of the color deviation correction control can be determined more accurately than in the first embodiment. Further, the consumption amount of toner is the same as in the normal discharge toner, which does not impair the interests of users.

As described above, according to this embodiment, the toner consumed in the toner discharge can be effectively used as, for example, the toner image involved in the color deviation detection. This leads to the reduction of the execution frequency of the color deviation correction control.

(Other Embodiments)

Note that, the description has been directed to the image forming apparatus including the intermediate transfer belt 8, but the present invention can be diverted to the image forming apparatus that employs a method of transferring the toner image developed on the photosensitive drum 1 directly onto the transfer material. That is, the same effect can also be obtained by replacing the intermediate transfer belt 8 with a transfer material transport belt (surface of a recording material bearing member) so as to form such toner patches as illustrated in FIGS. 6, 9, and 11 on the transfer material transport belt. The transfer material transport belt can bear the toner image of the patch thereon, and in this respect, can function as an image bearing member in the same manner as the intermediate transfer belt 8. Further, the transfer material transport belt can also function as a belt used for transferring a toner image developed on the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-200107, filed Sep. 7, 2010, which is hereby incorporated by reference herein in its entirety.

What is claimed is:

1. An image forming apparatus comprising image forming sections provided for respective colors, wherein each of the image forming sections includes an electrophotosensitive member, a developing unit that develops a toner image on the electrophotosensitive member, a transfer unit that applies a transfer bias and transfers the toner image formed on the electrophotosensitive member onto a belt for transferring the toner image formed on the electrophotosensitive member, and an electrophotosensitive member cleaning unit that removes toner remaining on the electrophotosensitive member, said image forming apparatus comprising:

a detection unit that detects the toner image transferred onto the belt by the image forming section; and a toner discharge unit that forcedly discharges toner from the developing unit and forms the toner image on the electrophotosensitive member, wherein the transfer unit applies a first transfer bias with a predetermined transfer efficiency with respect to the belt, for a predetermined area part of the toner image, and applies a second transfer bias whose transfer efficiency is at least smaller than the predetermined transfer efficiency of the first transfer bias, for a part excluding the predetermined area part of the toner image.

2. An image forming apparatus according to claim 1, wherein the detection unit detects the toner image transferred onto the belt according to the applying of the first transfer bias; and the image forming apparatus further comprises a control unit that performs color deviation correction control based on detection results obtained by the detection unit.

3. An image forming apparatus according to claim 1, further comprising a control unit that forms a test pattern comprising toner images whose number is larger than a number of toner images transferred by the predetermined area part of the toner image, and performs color deviation correction control based on detection results of the test pattern by the detection unit, wherein the control unit calculates a color deviation amount based on a result by the detection unit in a case of detecting the predetermined area part of the toner image, and determines whether or not to perform the color deviation correction control based on the color deviation amount.

4. An image forming apparatus according to claim 1, wherein the predetermined area part of the toner image includes areas in multiple toner images; and an interval between the multiple toner images in a rotation direction of the belt has a length of an odd multiple of a half rotation cycle of the belt in image forming processes except an image forming by the developing unit.

5. An image forming apparatus according to claim 1, wherein the predetermined area part of the toner image corresponds to areas of toner images corresponding to at least a first predetermined area part, a second predetermined area part, and a third predetermined area part;

an interval between the toner image corresponding to the first predetermined area part and the toner image corresponding to the second predetermined area part in a rotation direction of the belt has a length of an odd multiple or a substantially odd multiple of a half rotation cycle of a first rotary member; and an interval between a position determined based on the toner image corresponding to the first predetermined area part and the toner image corresponding to the second predetermined area part and a position of the toner image corresponding to the third predetermined area part in the rotation direction of the belt has a length of an odd multiple or a substantially odd multiple of a half rotation cycle of a second rotary member except the developing unit.

6. An image forming apparatus according to claim 1, wherein the predetermined area part of the toner image includes areas of toner images corresponding to at least a first predetermined area part, a second predetermined area part, and a third predetermined area part, wherein an interval between the toner image corresponding to the first predetermined area part and the toner image corresponding to the second predetermined area part in a rotation direction of the belt has a length of an odd multiple or a substantially odd multiple of a half rotation cycle of a first rotary member, which is longer than one rotation cycle of the developing unit; and an interval between the toner image corresponding to the first predetermined area part and the toner image corresponding to the third predetermined area part has in the rotation direction of the belt a length of an odd multiple or a substantially odd multiple of a half rotation cycle of a second rotary member.

7. An image forming apparatus according to claim 5, wherein the toner images corresponding to the first predetermined area part, the second predetermined area part, and the third predetermined area part, which have been developed on the electrophotosensitive member, include a blank part in which no toner image is formed at least at one of portions before and after the toner images in the rotation direction of the belt.

8. An image forming apparatus according to claim 6, wherein the toner images corresponding to the first predetermined area part, the second predetermined area part, and the third predetermined area part, which have been developed on the electrophotosensitive member, comprise a blank part in which no toner image is formed at least at one of portions before and after the toner images in the rotation direction of the belt.

9. An image forming apparatus according to claim 1, wherein the part excluding the predetermined area part is a non-continuous area; and the toner image corresponding to the part excluding the predetermined area part comprises a blank portion in which no toner image is formed at least at one of portions before and after the toner image in a rotation direction of the belt.

10. An image forming apparatus according to claim 1, wherein a total length of the toner image to which the first transfer bias and the second transfer bias are applied in a rotation direction of the belt is longer than a length corresponding to one rotation cycle of the developing unit in the rotation direction of the belt.

* * * * *